United States Patent [19]

McMillin

[11] Patent Number: 4,768,781

[45] Date of Patent: Sep. 6, 1988

[54] POOL TABLE AND BALL RACK APPARATUS

[76] Inventor: Roy E. McMillin, 43 Crosshill Rd., West Hartford, Conn. 06107

[21] Appl. No.: 11,282

[22] Filed: Feb. 5, 1987

[51] Int. Cl.[4] ..... A63D 15/00

[52] U.S. Cl. ..... 273/3 B; 273/5 B; 273/22

[58] Field of Search ..... 273/3 R, 3 A, 3 B, 3 C, 273/5 B, 6, 22, 280; 108/144

[56] References Cited

U.S. PATENT DOCUMENTS

| | | | |
|---|---|---|---|
| D. 66,386 | 1/1925 | Trost | 273/3 A |
| 675,273 | 5/1901 | Fuller | 273/3 B |
| 2,262,610 | 11/1941 | Kellerman | 273/3 |
| 2,361,471 | 10/1944 | Fontaine, Jr. | 273/123 |
| 3,618,944 | 11/1971 | Myers | 273/22 |
| 3,941,378 | 3/1976 | Bagley | 273/5 R |
| 4,171,807 | 10/1979 | Lamlee | 273/3 A |
| 4,307,881 | 12/1981 | Jaworski | 273/22 |
| 4,549,737 | 10/1985 | Seyer et al. | 273/118 R |

FOREIGN PATENT DOCUMENTS

| | | | |
|---|---|---|---|
| 24059 | of 1911 | United Kingdom | 273/3 B |
| 383825 | 11/1932 | United Kingdom | 108/144 |
| 2138306 | 10/1984 | United Kingdom | 273/3 A |

*Primary Examiner*—Richard C. Pinkham
*Assistant Examiner*—T. Brown
*Attorney, Agent, or Firm*—Henderson & Sturm

[57] ABSTRACT

A game device including a bordered playing field having a number of pockets formed in the field to receive target balls. The device includes a star-shaped rack having five spaced compartments, each of which receives and aligns a group of three target balls in a broken ring around a centrally positioned target ball. The shooter ball is positioned outside the ring and the game player uses a cue stick to strike and propel the shooter ball toward an appropriate target ball. The height of the playing field is adjustable and the playing field rotates to provide convenient access to elderly or handicapped players. The device is also conveniently disassembled for storage or shipping.

18 Claims, 1 Drawing Sheet

POOL TABLE AND BALL RACK APPARATUS

TECHNICAL FIELD

This invention relates to game devices, and more particularly to a rotatable and vertically adjustable billiard table suitable for playing a spin pool game.

BACKGROUND ART

Numerous pool-type games are known, but none are conveniently accessible to the elderly or handicapped. Those devices that are somewhat accessible to these groups do not provide a significantly varied game format that will maintain the interest of the players over an extended period of time.

Those concerned with these and other problems recognize the need for an improved pool-type game device.

DISCLOSURE OF THE INVENTION

The present invention provides a game device including a bordered playing field having a number of pockets formed in the field to receive target balls. The device includes a star-shaped rack having five spaced compartments, each of which receives and aligns a group of three target balls in a broken ring around a centrally positioned target ball. The shooter ball is positioned outside the ring and the game player uses a cue stick to strike and propel the shooter ball toward an appropriate target ball. The height of the playing field is adjustable and the playing field rotates to provide convenient access to elderly or handicapped players. The device is also conveniently disassembled for storage or shipping.

An object of the present invention is the provision of an improved pool-type game device.

Another object is to provide a pool-type game that is flexible, interesting and challenging for all ages.

A further object of the invention is the provision of a pool-type device that is conveniently accessible to the elderly and handicapped.

Still another object is to provide a pool-type game device that is compact, mobile and easily disassembled for storage or shipping.

A still further object of the present invention is the provision of a pool-type game device that is inexpensive to manufacture and easy to maintain.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
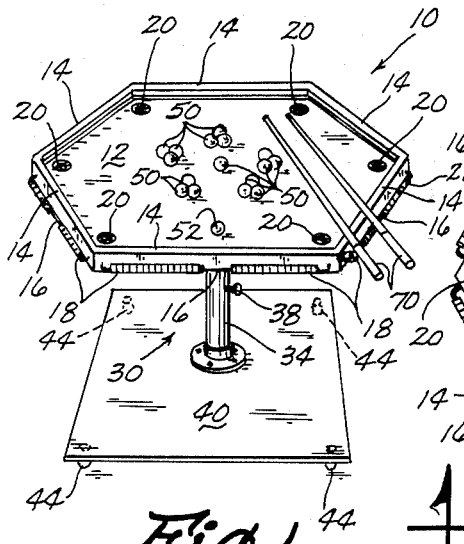
FIG. 1 is a perspective view of the pool-type game device of the present invention illustrating the relative positions of the target balls and shooter ball at the start of a game.

Referring now to the drawings, wherein like reference numerals designate identical or corresponding parts throughout the several views, FIG. 1 shows the pool-type game device (10) that includes a hexagonal playing field (2) bordered by a six-sided bumper wall (14). The outer surface of each side of the wall (14) supports a wire (16) that carries a number of scoring beads (18). The top surface of the playing field (12) has six pockets (20), one being located near each of the six corners of the field (12). The pockets (10) are formed of a netting or other suitable material.

Figure 3:
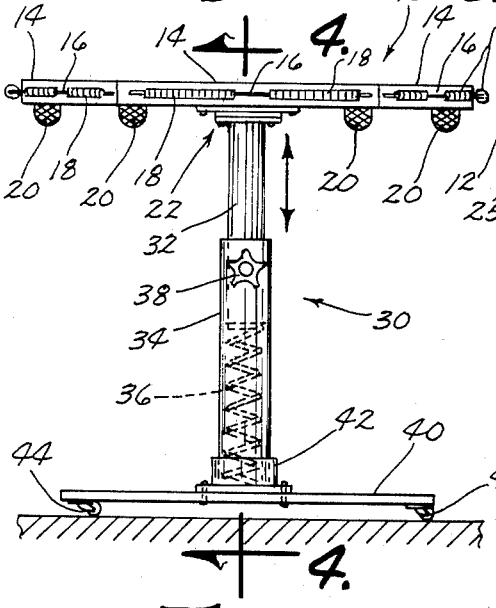
FIG. 3 is a side elevational view taken along line 3—3 of FIG. 2, and illustrates the vertical adjustment of the pedestal leg and the location of the upwardly biasing compression spring (dashed lines)
Figure 4:
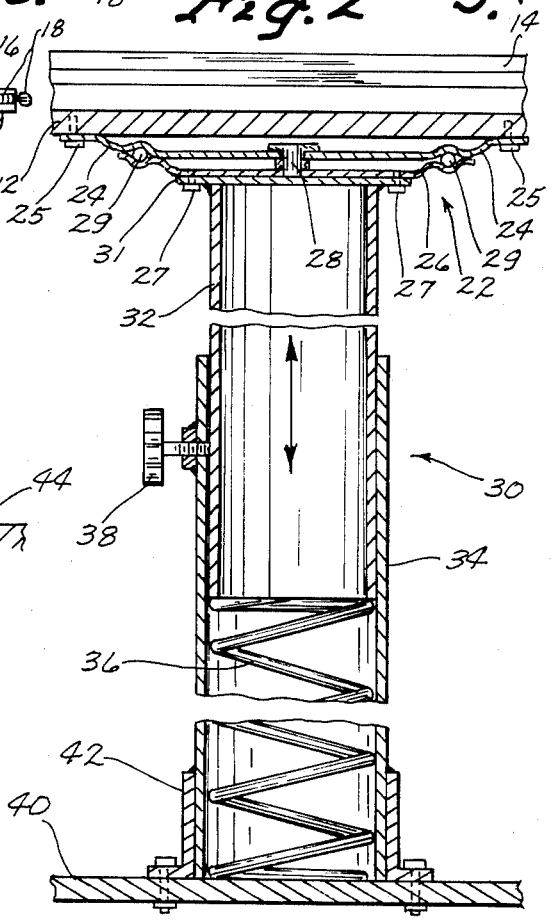
FIG. 4 is a greatly enlarged sectional view taken along line 4—4 of FIG. 3 and shows the turntable bearing interconnecting the playing field and the pedestal leg together with the vertical height adjustment.

Referring now to FIGS. 3 and 4, the playing field (12) is rotatably and releasably attached by a turntable bearing (22) to a pedestal support leg (30). The bearing (22) includes an upper flange (24) releasably attached by bolts (25) to the underside of the playing field (12), and a lower flange (26) attached by bolts (27) to a plate (31) at the top of support leg (30). The upper and lower flanges (24 and 26) are connected by pin (28) and rotate on ball bearings (29).

The support leg (30) includes a top sleeve (32) telescopically received in a larger bottom post (34). A compression spring (36) contacts and supports the top sleeve (32) and biases it toward a raised position. A set screw (38) holds the support leg (30) at the selected vertical height. A base (40) carries a centrally located socket (42) that matingly receives the lower part of the bottom post (34). The base (40) is movably supported on caster wheels (44) for easy transport from place to place while assembled.

Figure 2:
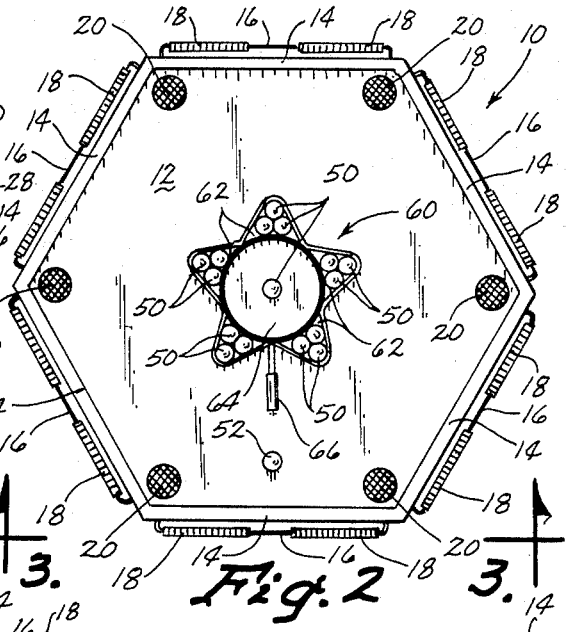
FIG. 2 is an enlarged top plan view showing the star-shaped rack used to receive and align five groups of three target balls around a centrally positioned target ball, and showing the shooter ball positioned outside the rack.

As best shown in FIG. 2, the game includes a plurality of target balls (50) which are individually numbered from one through sixteen, and a white cue or shooter ball (52). The target balls (50) are positioned and aligned on the playing field (12) by use of a star-shaped rack (60). The rack (60) includes five spaced compartments (62) each of which holds three target balls (50). The rack (60) also includes an open central area (64) and a grip handle (66).

In use, the pool-type game device (10) is assembled and the height is adjusted to suit the players by loosening the set screw (38), pushing down on the top surface of the playing field (12), and retightening the set screw (38). The star-shaped rack (60) is used to position and align the target balls (50) on the playing field (12) such that the gold colored target ball (50) bearing the number sixteen is positioned in the center of the playing field (12) and the shooter ball (52) is positioned outside the rack (60). Use of the rack (60) insures that sufficient space is left between each group of three target balls (50) to allow passage of the shooter ball (52) into the open central area (64). The order of players is then determined and the first player rotates the playing field (12) so that the first player is not required to move to play. The first player uses a cue stick (70) to strike the shooter ball (52) and propel it toward the desired target ball (50). After each shot, the playing field (12) is rotated, if necessary, to properly position the player to make the next shot. Scoring for each player is recorded by positioning of the designated set of scoring beads (18).

The game device (10) can be easily moved from location to location because the base (40) is mounted on caster wheels (44). Also, the device (10) can be disassembled for storage or transport by removing bolts (25) and lifting the bottom post (34) of the support leg (30) out of the socket (42).

Various pool-type game formats can be devised and played using the present invention, and the games can conveniently be played by both the elderly and the handicapped. It is to be understood that the following game rules are given as examples and in no way limit the possible application of the game device (10).

EXAMPLE 1

Rules of the game of "Marble Spin Pool"

Numbered target balls (50), numbered one to sixteen, plus a non-numbered shooter ball (52) are used. The shooter ball (52) is the last ball to shoot. If it is pocketed in one shot, the score is five points.

The gold target ball (50) is positioned in the center and the white shooter ball (52) is placed at any side of table at a starting dot. The first shot is directed to hit the gold target ball (50) by going in between two groups of three target balls (50). If this is accomplished, the score is fifteen points. If other target balls (50) are struck before the gold target ball (50) there is no score. The gold target ball (50) if pocketed any time during the game, scores five points; if it is left on the table until the last ball before the shooter ball (52), it is scored as fifteen points, if pocketed. Ten points are scored for each ball pocketed except for special points as stated above.

If the gold ball (50) stops on a gold dot on the playing field, without shooting it, at any time during the game, the score is ten points. A call target ball (50) if pocketed in one shot, scores ten points; if not pocketed, five points deducted. A push or shove shot, where the shooter ball (52) is shoved or pushed with the shooter stick (70) results in a ten point penalty. When any ball (50 or 52) leaves the table, the penalty is ten points. The first player reaching one-hundred points wins.

EXAMPLE 2

Practice Games for Younger Children

The numbered balls (50), except for the gold target ball (50), are used. The player that pockets the highest added numbers on the balls (50) wins the game.

Pee Wee scatter marble pool is played with any amount of pee wee marbles up to seventy-five marbles. Whichever player pockets the most marbles placed on the playing field wins. Both games are played with the cue sticks (70).

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A game device comprising:
   - a playing field bordered by an upwardly extending bumper wall, said field including a plurality of pockets;
   - a plurality of target balls positioned upon said field;
   - a shooter ball positioned on said field for use by a game player; and
   - a rack including five spaced compartments disposed in a generally star-shaped configuration, each of said compartments being disposed to receive and align a group of target balls at the start of a game, said compartments being generally disposed at a periphery of an open area such that the spacing between each group of balls is large enough to allow passage of said shooter ball into said open area without contacting any of said group of target balls.

2. The game device of claim 1 further including a cue stick used by the game player to strike and propel the shooter ball toward the target balls.

3. The game device of claim 1 including sixteen target balls.

4. The game device of claim 3 wherein said target balls are individually numbered from one through sixteen.

5. The game device of claim 4 wherein the target ball numbered sixteen is gold in color.

6. The game device of claim 5 wherein said gold target ball is centrally positioned in said open area of said rack at the start of a game.

7. The game device of claim 6 wherein said target balls numbered one through fifteen are positioned in groups of three within each of the five compartments at the start of a game.

8. The game device of claim 7 wherein said target balls are generally centrally positioned by said rack on the playing field at the start of a game.

9. The game device of claim 8 wherein said shooter ball is freely positioned outside said rack by a game player at the start of a game, such that the shooter ball can be propelled to strike the gold target ball without first striking the other target balls.

10. A game device comprising:
   - a hexagonal playing field bordered by an upwardly extending bumper wall, said field including six pockets, one pocket being disposed adjacent each corner of said field;
   - a pedestal support leg rotatably and releasably attached to the underside of said field, said leg including a top sleeve telescopically received within a bottom post, said leg being vertically adjustable between a raised position and a lowered position and being biased toward said raised position by a compression spring disposed within said bottom post to contract and support said top sleeve;
   - a base supported by a number of floor engaging caster wheels, said base including a centrally located upwardly directed socket disposed to releasably receive said bottom post of said support leg;
   - a plurality of target balls positioned upon said field;
   - a shooter ball positioned on said field for use by a game player; and
   - a rack including five spaced compartments disposed in a generally star-shaped configuration, each of said compartments being disposed to receive and align a group of target balls at the start of a game, said compartments being generally disposed at the periphery of an open area such that the spacing between each group of target balls is large enough to allow passage of said shooter ball into an open area without contacting any of said group of target balls.

11. The game device of claim 10 further including a cue stick used by the game player to strike and propel the shooter ball toward the target balls.

12. The game device of claim 10 including sixteen target balls.

13. The game device of claim 12 wherein said target balls are individually numbered from one through sixteen.

14. The game device of claim 13 wherein the target ball numbered sixteen is gold in color.

15. The game device of claim 14 wherein said gold target ball is centrally positioned in said open area of said rack at the start of a game.

16. The game device of claim 15 wherein said target balls numbered one through fifteen are positioned in groups of three within each of the five compartments at the start of a game.

17. The game device of claim 16 wherein said target balls are generally centrally positioned by said rack on the playing field at the start of a game.

18. The game device of claim 17 wherein said shooter ball is freely positioned outside said rack by a game player at the start of a game, such that the shooter ball can be propelled to strike the gold target ball with first striking the other target balls.

* * * * *